United States Patent [19]

Karpenko

[11] 4,338,961

[45] Jul. 13, 1982

[54] VALVE FOR HANDLING HOT CAUSTIC ALUMINA SOLUTION WITH PROVISION FOR GRINDING

[75] Inventor: Anatole N. Karpenko, San Francisco, Calif.

[73] Assignee: Anchor/Darling Valve Company, Bala Cynwyd, Pa.

[21] Appl. No.: 176,005

[22] Filed: Aug. 7, 1980

[51] Int. Cl.[3] ..... B24B 15/02

[52] U.S. Cl. ..... 137/243.2; 51/241 VS; 74/25; 74/89.15; 74/424.8 VA; 137/331; 251/81; 251/133; 251/229; 251/249.5; 251/267; 464/37

[58] Field of Search ..... 64/29; 51/27, 29, 30, 51/241 VC; 74/89.15, 424.8 R, 424.8 VA, 424.8 C, 25, 20; 137/243, 243.1, 243.2, 243.3, 243.6, 330, 331; 251/80, 81, 264, 267, 133, 134, 229, 248, 249.5, 218

[56] References Cited

U.S. PATENT DOCUMENTS

| | | | |
|---|---|---|---|
| 1,865,559 | 7/1932 | Montgrand | 64/29 |
| 2,253,466 | 8/1941 | Grohn | 64/29 |
| 2,996,075 | 8/1961 | Deimer et al. | 137/243 |
| 3,313,178 | 4/1967 | Saunders | 74/424.8 VA |
| 3,505,888 | 4/1970 | Denkowski | 74/89.15 |
| 4,114,851 | 9/1978 | Shivak et al. | 251/214 |
| 4,177,825 | 12/1979 | Crawford | 251/225 |

*Primary Examiner*—George L. Walton

[57] ABSTRACT

A valve structure is provided which can be opened and closed under operating conditions without any adjustment in conditions existing in the system in which the valve is an element. The valve element can be turned with respect to the seat to provide for proper relation between the valve element and the valve seat to grind one with respect to the other during the operating cycle. The valve also includes a clutch having a radial acting trip overload that prevents the valve seat from being damaged during grinding which is effected by turning the valve through the clutch while moving the valve toward the seat during the closing cycle and produces a controlled grinding operation independent of pressure within the valve.

When the valve is operated in the opposite direction, the clutch disengages and the actuator mechanism encounters only the thrust forces during the opening cycle. This allows the valve to be easily opened without overloading the system.

11 Claims, 6 Drawing Figures

VALVE FOR HANDLING HOT CAUSTIC ALUMINA SOLUTION WITH PROVISION FOR GRINDING

BACKGROUND OF THE INVENTION

In the Bayer process for the extraction of alumina from bauxite, finely ground calcined bauxite is charged into a heated pressure vessel containing a solution of caustic soda of about 45% strength. With a properly calcined material, the alumina passes into solution as sodium aluminate. When solution is complete, a matter of some hours, the pressure is released from the vessel and the contents are discharged into a receiving vessel.

To handle the strong hot solution one or more valves are required in the piping arrangement. A common occurrence is for material to deposit upon the elements of a valve such that the valve may become locked or the seating surfaces on the valve and the valve's orifice may become encrusted with material from the caustic solution with the result that the valve may be held in an open position or locked in a closed position.

Many of the prior art valves used in such a system are well summarized in the patent to Crawford U.S. Pat. No. 4,177,825 of Dec. 11, 1979 which also deals with such a valve. Although the valve described in Crawford U.S. Pat. No. 4,177,825 performs in a satisfactory manner at low and medium pressures, at high pressures, i.e., at pressures in excess of about 250 psi, the axially disengaging clutch mechanism of this valve may not always be substantially immediately responsive and may not provide the desired release, particularly at pressures in the vicinity of about 600 psi which limits its operational range. In contrast to the Crawford valve, the valve of the instant invention, due to the use of a radial clutch mechanism, allows the use of this valve over the entire pressure range presently existing in the usual Bayer process alumina plants.

The valve of the present invention is of lower cost, more rugged and of a simpler design than the Crawford valve. The valve of the present invention utilizes a radial clutch which disengages the valve disc from the drive shaft when a predetermined torque (disc/seat friction) is exceeded. This is accomplished by the use of heavy leaf springs acting on pawls which engage the disc body, the pawl leaf spring assembly being mounted on a rotor keyed to the valve stem.

SUMMARY OF THE INVENTION

It is in general the broad object of the present invention to provide an improved valve construction which is particularly useful in the processing of an alumina containing caustic solution generated in the aforementioned Bayer process for the treatment of bauxite ores. In that process multiple pumping and valve controlled operations are utilized with the aforementioned buildup of hydrated alumina alkali or silica scale on the wetted surface of the valve elements, particularly the valve seats, usually necessitating extensive and expensive maintenance practices.

It is another object to provide a valve mechanism in which the valve disc is rotated relative to the valve seat to effect relative grinding as part of the normal closing operation. The rotary movement is controlled by a cam actuated clutch mechanism which interrupts the rotary movement of the valve disc when a preselected frictional force is encountered between the disc and seat. Further, the clutch mechanism disengages from the valve disc during the opening cycle so that no grinding takes place.

Another object is to provide such a valve in which the frictional force between the valve disc and seat may be adjusted for different grinding requirements.

A further object is to provide a self grinding valve mechanism which has particular utility with large valves, in the order of 600 lbs., and which are used in adverse environments, such as in the aforementioned Bayer process. The valve of the present invention has the features of having the valve stem carry the valve disc for positive axial movement therewith but to allow relative rotary movement. The rotary movement is controlled by a trip mechanism which is dependent on the sliding frictional forces between the disc and seat. The positive axial movement of the stem and associated disc assures positive closing of the valve and also facilitates opening the valve against the high operating system pressures encountered in such valves.

A still further object is to provide an operating nut for the stem that includes a compressible spring assembly which permits a limited free axial movement of the stem while maintaining a preselected reaction force on the seat and disc during the grinding operation. At the end of the free movement the axial motion of the nut is stopped and a positive stem movement closes the valve.

Another object of the invention is to provide such a valve which can function in adverse environments without operator assistance and which may be operated from a remote location. Similarly, the working parts of the valve are sealed and shielded from the slurry and the contacting seal and disc seat are formed of hardened material to assure long time, trouble free operation.

DESCRIPTION OF THE PREFERRED EMBODIMENT

Figure 1:
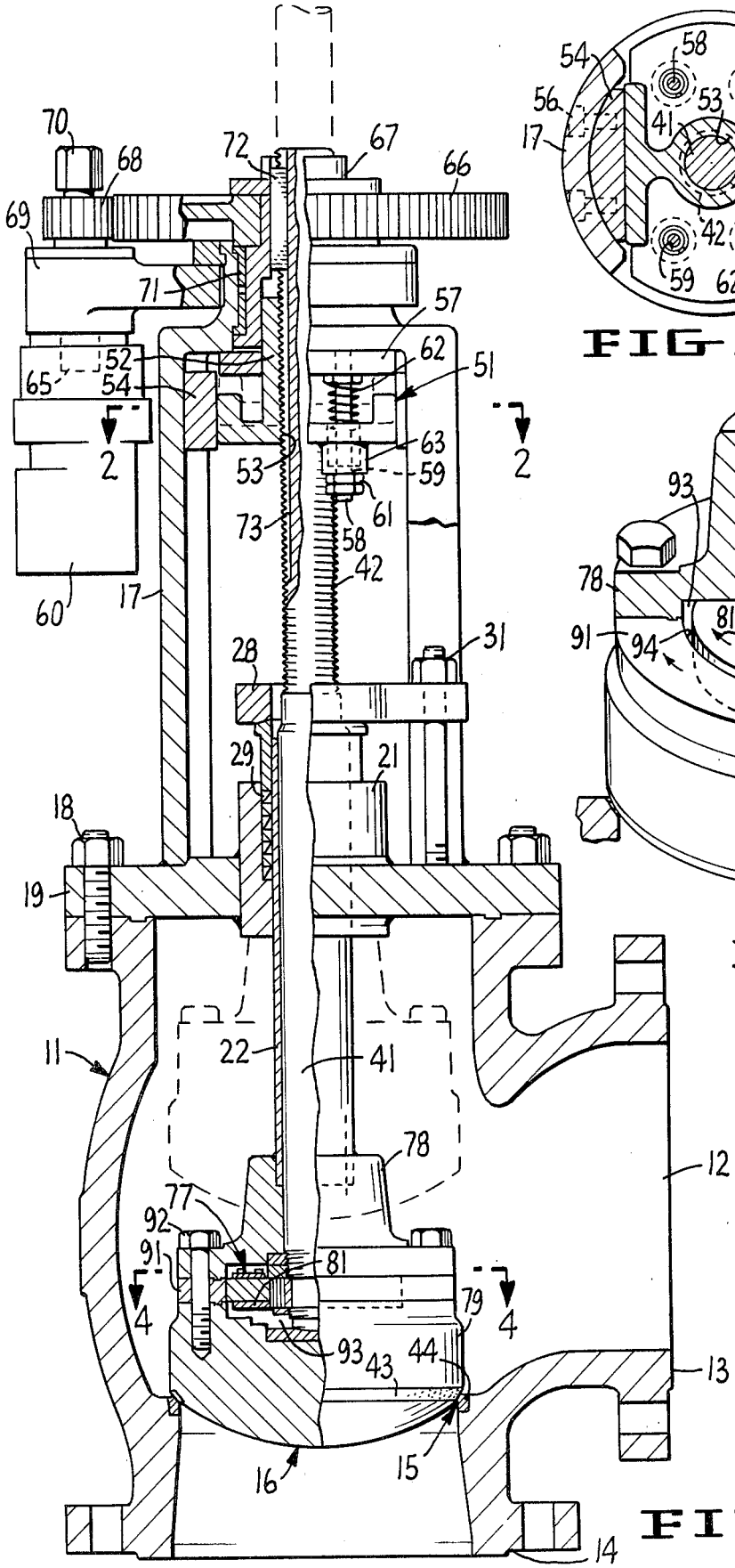
FIG. 1 is a vertical cross section of a valve showing the best mode of carrying out the construction of my invention.

The valve comprises a main body 11 having an inlet 12 defined by a flange 13 and an outlet 14 provided at an angle to the inlet 12. A seat 15 between the inlet and outlet cooperates with the valve closure element 16 to control the flow of material and fluid through the valve. Mounted upon the main body 11 is a bonnet 17 secured to the main body by stud and nut fasteners 18. The bonnet 17 includes a transverse flange 19 upon which is mounted a bearing 21 providing a slidable support for a sleeve 22 which extends upwardly from movable valve disc 16 through a stuffing gland generally indicated at 28 and having packing 29 provided about the sleeve 22. The packing gland is secured to flange 19 by several fasteners 31. The sleeve 22 fits snugly about the valve stem 41, the upper end of which is threaded as at 42 with a left hand thread. The lower end of the valve stem 41 is secured to the valve closure element 16.

The valve closure element 16 includes an annular seating face 43 cooperatively positioned with respect to annular seating face 44. In accordance with this invention, the surface of these two areas are coated with an extremely hard, well bonded, wear resistant coating. This material is applied by a unit designated by its manufacturer, Union Carbide Corporation, Linde Division, Coatings Service Department of Indianapolis, Ind. and known as a Detonation Gun. Union Carbide's description of the operation of this Gun is as follows:

"The D-Gun resembles a large-caliber machine gun. When measured quantities of oxygen, acetylene and particles of coating material are metered into the firing chamber, a timed spark detonates the mixture. This creates a hot, high-speed gas stream which instantly heats the particles to a plastic state and hurls them at supersonic velocity (2500 fps) from the gun barrel. The near molten particles impinge onto the surface of the workpiece where a microscopic welding action produces a tenacious bond. Rapid-fire detonations, during automatically controlled passes across the workpiece, build up the coating to a specified thickness."

"Although temperatures above 6,000° F. are reached inside the gun, the workpiece remains below 300° F. Thus, metallurgical properties of the base material are not changed during the coating process. Low temperatures in the substrate also eliminate the possibility of warpage, distortion or other physical change in precision parts."

The particular material is designated by Union Carbide as LW-5 and comprises 73% tungsten carbide, 20% chromium and 7% nickel. Reference is made to U.S. Pat. Nos. 2,714,563 and 3,071,489 of Union Carbide Corporation.

Figure 2:
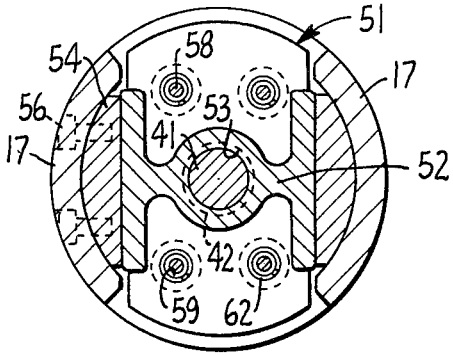
FIG. 2 is a section taken along the line 2—2 in FIG. 1.
Figure 3:
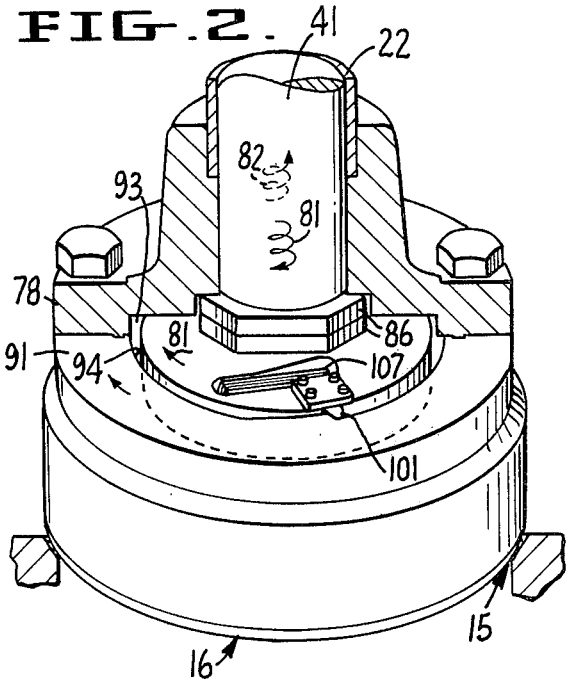
FIG. 3 is a perspective view of the valve disc shown in seating relation with the valve seat.

Mounted on the upper end of the threaded portion of the valve stem 41 is an assembly provided as a nut structure generally indicated at 51 (see FIG. 2). The structure 51 includes an operating nut 52 having a threaded bore 53 for receiving threaded stem 41. Nut 52 is slidable axially within the bonnet along glides 54 held to the upper end of bonnet 17 by machine screws 56. Upward travel of nut 52 is limited by transverse stop element 57 secured to the upper end of bonnet 17. Depending from element 57 are four threaded rods 58 which support nut 52 through bores 59 and lower stop nuts 61. Springs 62 interposed between stop element 57 and spring retainer sockets 63 on operating nut 52 bias the nut toward the stop nuts 61, that is in the downward direction as viewed in FIG. 1. This arrangement allows limited axial movement of the nut between stop 57 and stop nuts 61 and therefore a similar movement of the stem 41 and closure element 16 as is conventionally used, such as in the aforementioned Crawford patent.

A spur gear 66 is secured on the upper end of the valve stem 41 by a nut structure 67. The spur gear is rotated by a pinion gear 68, the pinion gear being mounted on extension 69 on the upper end of the bonnet 17. Spur gear 66 is journaled for rotation in bearings 71 at the top of bonnet 17 and carries key 72 in longitudinal keyway 73 in threaded stem 41. Rotation of gear 66 turns threaded stem 41 and causes axial movement of the closure element 16 through the action of nut structure 51 and also causes rotational movement of closure element 16 through the action of clutch structure 77 as will be described hereinafter. Rotation of pinion gear 68 may be actuated by an electric or hydraulic motor 60 mounted on coupling 65 and controlled as from a remote location. Rotation of the gear 68 can also be effected by socket 70 in a well known manual manner. It should be appreciated that the force needed to operate the closing element is much reduced from prior similar valves, especially during the opening cycle, because of the unique features of the clutch structure 77.

Clutch structure 77 is operative to rotate the valve closure element 16 when the stem is turning in the direction of arrow 81 during the closing cycle. When the valve stem is opening (in the direction of arrow 82) the clutch elements disengage and this releases any torque force between the closing element 16 and seat 15. Thus the valve can be opened without overloading the system or the stem or actuator. The grinding is effected only upon rotation in one direction, specifically the closing direction and not in the opening direction during which the combined loads of disc/seat friction, calcined cementation and system pressure would have to be overcome.

Looking to FIGS. 3 through 6, clutch structure 77 is carried at the lower end of stem 41 between upper and lower members 78 and 79 of closure element 16. A rotor 81 is fixed to stem 41 through keys 82 and is axially positioned between shoulder 83 and lower cap plate 84. Thrust forces are transmitted between the closure element 16 and stem 41 and rotor assembly 81 through retaining nuts 86 and lower spherical surface 87 seated on pad 88. Annular ring 91 carried between upper and lower members 78 and 79 and affixed thereto by machine screws 92 forms a cavity 93 in which rotor 81 is free to turn. The inner surface of ring 91 has a cam profile 94 which includes an annular race 96 interrupted by three equidistantly spaced lugs 97. Each lug has an elongated sloping ramp 98 and an abrupt catch surface 99. Trip members 101 slidably carried equidistantly about rotor 81 in radial slots 102 are confined by upper plate 103 secured to rotor 81 by screws 104. The inner ends of trip members 101 have cylindrical faces 106 which contact leaf spring assemblies 107 to bias the trip members radially outward to ride along cam surface 94. The outer face of members 101 is profiled to compliment catch 99 on one face and is rounded on the other face.

Figure 4:
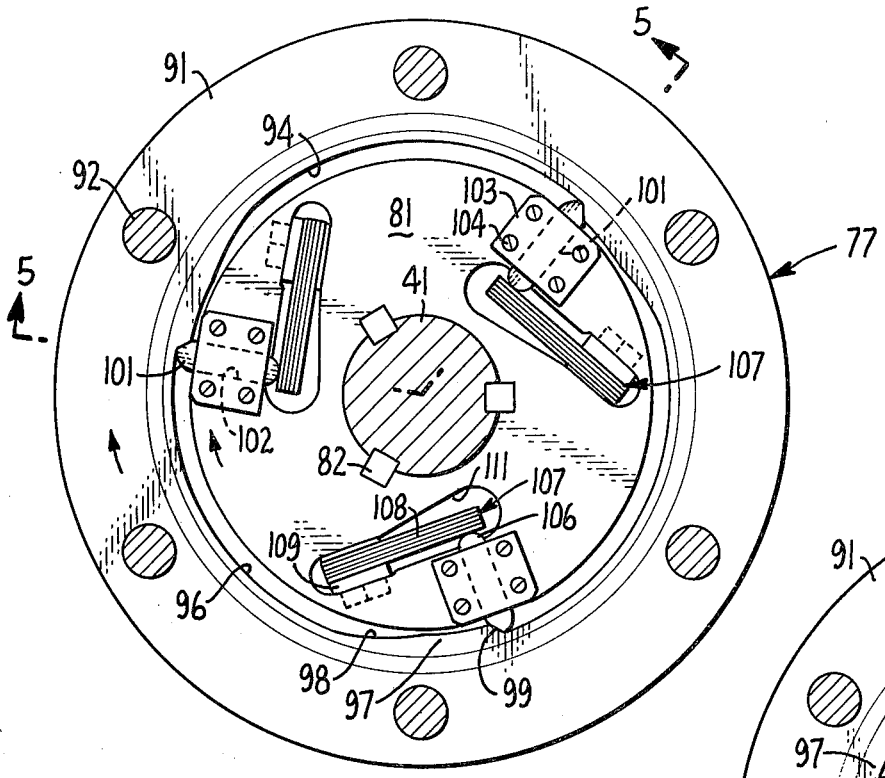
FIG. 4 is a section taken along the line 4—4 showing details of construction of a clutch arrangement utilized in the seating.
Figure 6:
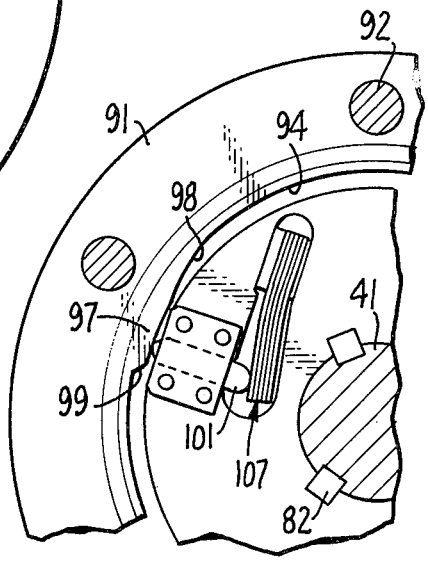
FIG. 6 is an enlarged sectional view showing construction and operation of the release of the valve element.
Figure 5:
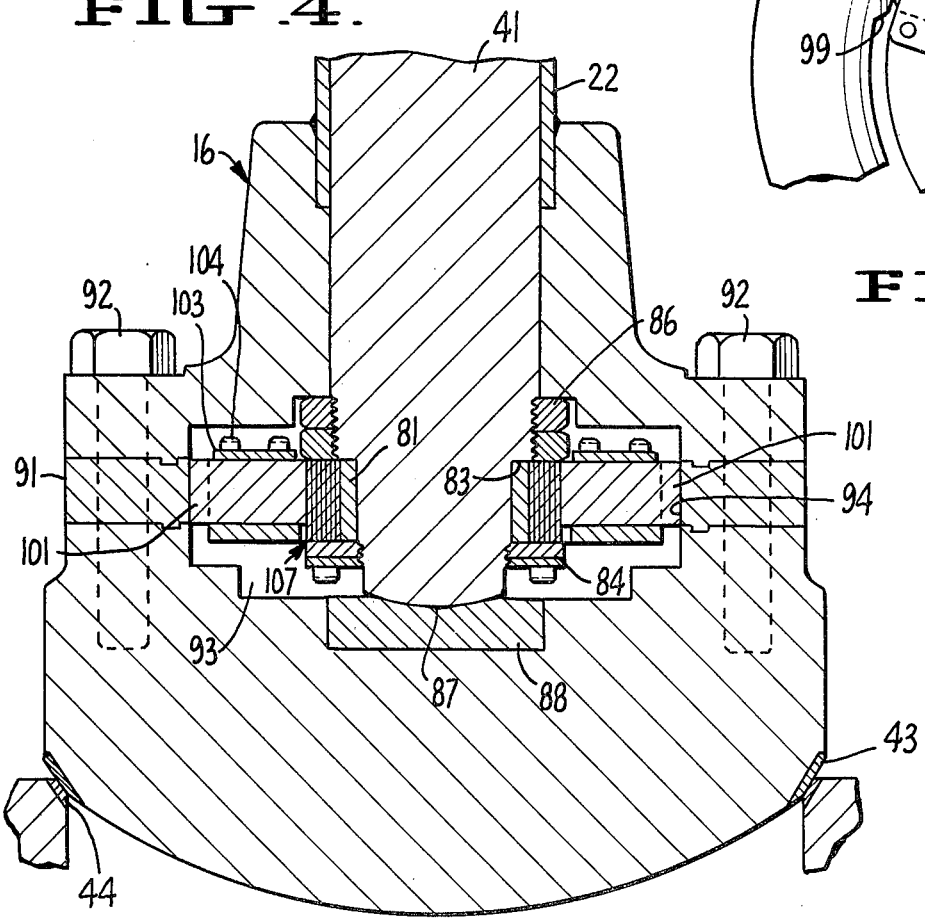
FIG. 5 is an enlarged cross section of the valve seating arrangement showing details of the construction and particularly of the grinding elements provided upon the valve element in the valve seat and taken along the line 5—5 in FIG. 4.

As shown in FIGS. 4 and 6, spring assemblies 107 include a series of leaf springs 108 secured at one end by fixtures 109 in slots 111 of rotor 81 and having their distal ends free to bear on trip members 101. The spring force of spring assemblies 107 is chosen to cooperate with the springs 62 of upper traveling nut 51 as will be described hereinafter. It should be noted that the rotor, sliding trip members, cam surface and spring assemblies are carried in cavity 93 where they may be supplied with a proper lubricant and are isolated from the adverse effects of the slurry or other fluid flowing through valve 11. Similarly coil springs 62, bearing 71 and any hydraulic actuator are spaced on bonnet 17 away from the effects of the heated slurry.

In operation, during the closing cycle, stem 41 is rotated by the spur gear drive 66 and will move valve element 16 in a longitudinal path from the dotted line position in FIG. 1 toward the valve seat 15. As can best be seen in FIG. 1, nut 52 is not fixed but is restrained from rotation by bonnet-yoke 17, two guides 54, so that nut 52 will move upwardly when the reaction force between disc and body seats overcomes springs thrust 62. Thus, nut 52 can move from the position shown in solid lines to the position shown in phantom so that nut 52 moves upwardly closing the gap between transverse stop element 57 and nut 52 when the frictional force will trip overload clutch 81, 101, 107 and seat reaction thrust on spring 62 is overcome. Nut 52 will be in its lower position from the previous cycle and spring 62 extended. Trip members 101 will be extended by leaf spring assemblies 107 to confront catch 99 of cam surface 94 and cause element 16 to rotate. As hardened surface 43 contacts any calcified residue around the seat area 44, the friction between the valve disc 16 and valve seat will increase. This will cause nut 52 to move upward compressing springs 62 to keep a fairly constant axial force by the disc on the seat and will maintain this force during rotation of the disc during the grinding operation which should be about 1½ revolutions. When the frictional force between the seat/disc becomes greater than the leaf spring force holding the trip members out, the trip members will move inward along lug 97 and disengage the rotor torque from sealing element 16. Continued stem rotation will further move nut 52 into contact with stop 57 at which time positive displacement of element 16 will occur and element 16 will be firmly seated. From the foregoing, it will be noted that it is the interplay between the forces of seal/disc frictional torque as defined by nut springs 62 and leaf springs 108 that determine the duration of the grinding cycle. Thus, when the valve is dry and the seal/disc frictional force is greater there is less grinding than when the seals are wetted. This overcomes the adverse effects of galling the seats by grinding them in the dry state which was a problem with current valves.

During the opening cycle, when stem 41 rotates, nut 52 will start to move downward and rotor 81 will rotate in cavity 93 but because trip members 101 now move along the elongated ramp portion 98 of the cam this rotary motion is not transmitted to element 16. At some point, either the force in the nut springs 62 will overcome the fluid system pressure or the nut will contact stop nuts 61 and stem 41 will move longitudinally upward to pull seal element 16 from seat 15. As mentioned earlier, since the disc is not rotating during the opening cycle the force needed to turn stem 41 is much reduced and the overall load on the entire system and actuator is greatly reduced over prior valves which is especially important in the larger size valves.

From the foregoing it will be seen that I have provided an improved self grinding valve in which the operative mechanism may work under preselected conditions of force and one-way operation which has particular utility for use under adverse conditions such as those found in the alumina industry.

I claim:

1. A valve comprising, a valve body having a valve seat, a closure member formed to fit said seat and control the flow through said valve body, stem means for moving said closure member toward and away from said valve seat to cause frictional engagement of said closure member on said seat, rotating means operatively connected to said valve stem means for rotating said closure member relative to said seat to effect a grinding thereof, and trip means being mounted on rotor means positioned on the lower end of said valve stem means capable of interrupting the rotational movement of said closure member at a preselected frictional force between said closure member and said seat, said trip means including members slidably mounted in slots in said rotor means with one end of said slidable members engaging spring means located in recesses in said rotor means and the other end of said slidable members engaging cam means on a fixed member mounted within said closure member for radial movement, whereby said trip means operates independently of pressure within the body of said valve.

2. The valve of claim 1 wherein said trip means is interposed between said closure member and said rotating means and forms an operative coupling therebetween.

3. The valve of claim 2 wherein said trip means operatively couples said rotating means with said closure member for rotation in only one direction.

4. The valve of claim 1 wherein said trip means interrupts said rotational movement between said closure member and said seat at a frictional force therebetween which allows the closure member to move toward the seat to close thereon and wherein the final closing motion of the valve is performed without rotational movement of the closure member on the seat.

5. A self-grinding valve comprising, a valve body having an inlet and an outlet and a valve seat therebetween, a movable closure member formed to move toward and away from said seat to form a seal therewith and control the flow through said valve body, valve stem means journaled in said valve body and having a thrust-type coupling with said closure member wherein longitudinal movement of said stem means causes the closure member to move relative to said seat, rotating coupling means disengagably carried between said stem means and said closure member wherein rotation of said stem means causes selected rotation of said closure member relative to said seat and effect selected grinding of said closure member on said seat, and trip means interposed in rotor means between the lower end of said stem means and the interior of said closure member to interrupt said rotational movement at a pre-determined frictional grinding engagement between said closure member and said seat, said trip means including members slidably mounted in slots in said rotor means with one end of said slidable members engaging spring means located in recesses in said rotor means and the other end of said slidable members engaging cam means on a fixed member mounted within said closure member for radial movement, whereby said trip means operates independently of pressure within the body of said valve.

6. The valve of claim 5 including an operator mechanism coupled to said stem means and adapted to rotate the stem means to effect a grinding operation through the rotating coupling means and the trip means and to move the stem means longitudinally relative to the valve seat to effect closing and opening movement of the closure member with respect to the seat.

7. The valve of claim 6 wherein said operator mechanism includes a longitudinally sliding structure which allows limited free longitudinal travel of the stem, and biasing means associated with said sliding structure wherein, during the grinding operation, the closure member will be held on the seat with a force provided by said biasing means.

8. The valve of claim 7 wherein said stem means is threadably coupled to said operator mechanism through said sliding structure.

9. The valve of claim 8 wherein said trip means of said rotating coupling includes biasing means forming therewith a disengagable coupling between said stem member and said closure member dependent on the force provided by said biasing means, and wherein said biasing means of said sliding structure exerts a force between the closure member and seat that is greater than the force of the bias means of the trip means such that the grinding operation will be interrupted during the limited free longitudinal travel of the stem and thereafter the closure member may close on the seat without any grinding taking place.

10. The valve of claim 9 wherein said rotating coupling means is only operative during the closing operation of the valve.

11. The valve of claim 11 wherein said closure member includes an elongated sleeve formed to include said valve stem means and shield it from material flowing through said valve.

* * * * *